United States Patent [19]

Becker

[11] 3,966,476

[45] June 29, 1976

[54] SPECTRALLY SENSITIZED SILVER HALIDE EMULSION CONTAINING MORE THAN 50% OF THE GRAINS WITH RIPENING NUCLEI IN CAVITIES

[75] Inventor: Manfred Becker, Leverkusen, Germany

[73] Assignee: AGFA-Gevaert, A.G., Leverkusen, Germany

[22] Filed: Feb. 11, 1974

[21] Appl. No.: 440,976

[30] Foreign Application Priority Data

Feb. 9, 1973 Germany ..... 2306447

[52] U.S. Cl. ..... 96/107; 96/108; 96/120; 96/94 R

[51] Int. Cl.[2] ..... G03C 1/28; G03C 1/08

[58] Field of Search ..... 96/120, 107, 108, 94 R

[56] References Cited

UNITED STATES PATENTS

| | | | |
|---|---|---|---|
| 2,592,250 | 3/1949 | Davey et al. | 96/114.7 |
| 3,206,313 | 9/1965 | Porter et al. | 96/107 |
| 3,317,322 | 5/1967 | Porter et al. | 96/107 |
| 3,367,778 | 2/1968 | Berriman | 96/108 |
| 3,586,505 | 6/1971 | Ridgway | 96/107 |
| 3,761,266 | 9/1973 | Milton | 96/107 |

*Primary Examiner*—Won H. Louie, Jr.
*Attorney, Agent, or Firm*—Connolly and Hutz

[57] ABSTRACT

High sensitive silver halide emulsions are obtained by the production of a new kind of sensitivity nuclei which are called troglodyte nuclei and which are described hereinafter.

2 Claims, 1 Drawing Figure

Figure 1:
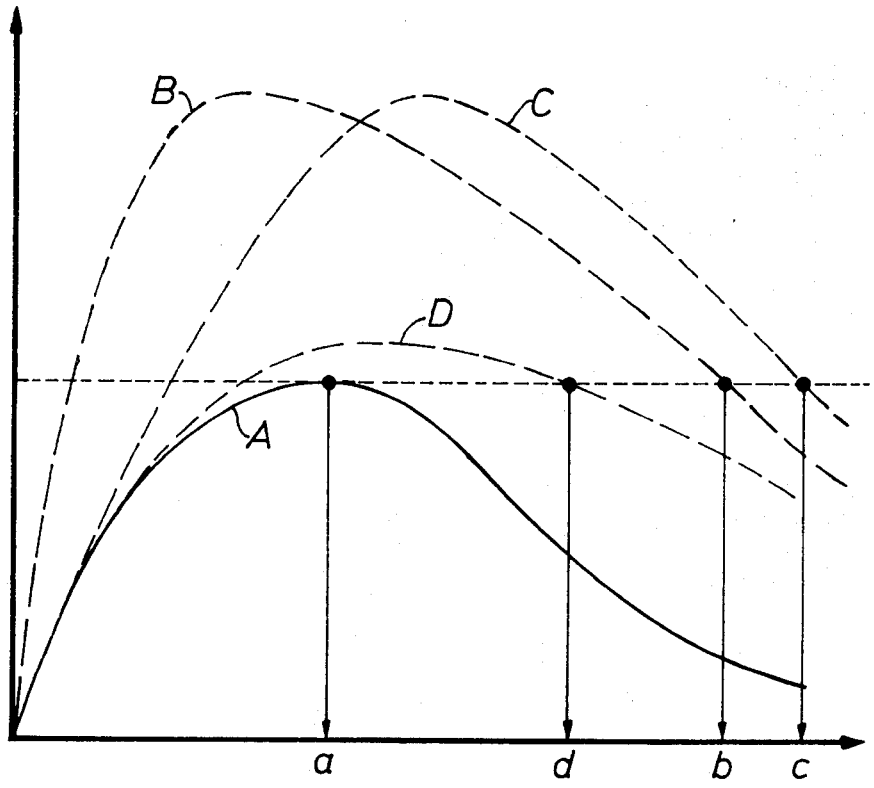

SPECTRALLY SENSITIZED SILVER HALIDE EMULSION CONTAINING MORE THAN 50% OF THE GRAINS WITH RIPENING NUCLEI IN CAVITIES

This invention relates to a photographic recording material consisting of a support and at least one negative silver halide emulsion layer which may be spectrally sensitized and in which most of the silver halide grains have surface sensitivity and can therefore be developed by surface developers after exposure.

It is known that negative silver halide emulsions can be spectrally sensitized with many organic dyes. It is also known that sensitizing dyes also have desensitizing properties and that optimum spectral sensitization is obtained when the concentration of sensitizing dye is considerably below the concentration which would be required to produce a continuous monomolecular layer of sensitizing dye. In optimally sensitized silver halide emulsions, therefore, the surface of the silver halide grains is only partly covered with sensitizing dye, e.g. up to one third. The absorption of light does not therefore reach the maximum possible value.

It is known that the desensitizing properties of sensitizing dyes can be suppressed by using so-called internal nuclei emulsions, i.e. silver halide emulsions which contain ripening nuclei or other inclusions with a similar effect in the interior of the grain. Exposure of such emulsions results mainly in an internal latent image and practically no surface latent image.

Internal nuclei emulsions are, however, of limited utility because they can only be developed with special developers, the so-called internal nuclei developers. Internal nuclei developers contain either silver halide solvents such as sodium thiosulfate or silver halide converting agents such as potassium iodide which will liberate the latent internal image nuclei. Silver halide solvents are very liable to cause fogging and reduce the covering power of silver. Potassium iodide does not have these disadvantages but the potassium iodide content of the developer must be very accurately adjusted for each emulsion because, if the potassium iodide content is too low, the internal nuclei will be insufficiently revealed whereas if it is too high, the latent internal image nuclei are liable to become enveloped with silver iodide.

These disadvantages do not occur in developers which develop exclusively or almost exclusively the surface latent image.

It is also known that desensitization, i.e. reduction in the sensitivity to light, can be brought about in silver halide emulsions by moist atmospheric oxygen. There is therefore a demand for means of suppressing such undesirable desensitization effects which, as indicated above, are caused by higher concentrations of optical sensitizers or by atmospheric oxygen, and thereby improving the light sensitivity of photographic silver halide emulsions both in the sphere of spectral sensitization and in the characteristic sensitivity of the emulsion itself.

It is among the objects of this invention to provide photographic silver halide emulsions which can be developed in surface developers after exposure to light and which have increased sensitivity to light, especially in the region of spectral sensitization, without concomitant increase of the grain size.

We now have found a photographic material containing at least one light-sensitive silver halide emulsion layer capable of being developed in surface developers after exposure to light in which the silver halide grains of the emulsion contain ripening nuclei which are arranged in a cavity which is open to the external surface of the grain. In the emulsion according to the invention, the majority of the silver halide grains, i.e. more than 50 % of the total number of grains, must be capable of development in surface developers.

The depth of this cavity which is open to the outside is preferably up to 60 and more particularly 5 to 50 lattice planes. The depth of the cavities also depends on the crystal form and the position of the ripening nuclei on the crystal.

The novel nuclei will hereinafter be termed troglodyte nuclei. They are characterized by the fact that on the one hand they can be developed by surface developers but on the other hand they are less sensitive to desensitizing influences than surface nuclei. A substantially higher sensitivity of the silver halide emulsions to light is thereby achieved without any increase in the grain size.

These troglodyte nuclei are ripening nuclei which are neither surface nuclei nor internal nuclei. They differ from surface nuclei by the fact that they are situated more deeply down in the grain and they differ from internal nuclei in that they are not completely surrounded by silver halide inside the grain but communicate with the outside. The troglodyte nuclei are therefore ripening nuclei which are entirely or partly seated inside a cavity which is open to the surface of the grain (which cavity has not been formed by conversion of silver halide on the surface of the grain into silver sulfide or silver in the process of chemical sensitization).

The emulsions according to the invention which contain troglodyte nuclei can be prepared from various heterodisperse or homodisperse silver halide emulsions which have been chemically sensitized on the surface. The substances used for chemical sensitization are preferably sulfur compounds, e.g. thiosulfates, polythionates, thiocyanates or gelatin constituents which contain sulfur or gold compounds such as tetrachloroaurate(III), dithiosulfatoaurate(I), dithiocyanatoaurate(I) and the like.

The photographic silver halide emulsions according to the invention may be prepared by various methods.

According to a preferred embodiment of the process, a specified quantity of additional silver halide is precipitated on a silver halide emulsion which has been chemically sensitized on the surface. To convert the surface nuclei of the original emulsion into the troglodyte nuclei which characterize this invention, a quantity of silver halides lying within a particular range must be precipitated on the orignal emulsion.

The upper limit of this range is determined by the fact that more than half the surface nuclei must remain incompletely covered by silver halide and therefore still available to surface developers. Surface nuclei can remain available to surface developers in spite of the precipitation of silver halide on them because the accretion of the additional silver halide takes place by formation of new lattice planes on the existing lattice planes of the silver halide grains whereas accretion of silver halide lattice planes does not occur on sulfidic or metallic ripening nuclei. The ripening nuclei are therefore increasingly surrounded by silver halide and partly or completely enclosed in a cavity which is open to the crystal surface. The troglodyte nuclei which characterize the emulsions according to this invention are finally obtained. If the quantity of additional silver halide precipitated is too high, the openings on the crystal surface finally close and the troglodyte nuclei become internal nuclei.

The lower limit of the range of additional quantity of silver halide precipitated is determined by the fact that the sensitivity of the original emulsion which has been chemically sensitized on the surface and only contains surface nuclei must be increased by 0.02 log E ($\neq$4.7 %) by the precipitation.

The quantity of silver halide precipitated is preferably such that the increase in sensitivity in the desired spectral range obtained in accordance with the invention is at least half the maximum possible. The quantity of silver halide which must be precipitated to result in the maximum sensitivity, optionally in combination with one or more sensitizing dyes, can easily be determined experimentally.

Precipitation of silver halide on the silver halide emulsion which has been chemically sensitized on the surface may be carried out by the usual methods, for example those described by P. CLAES and R. BERENDSEN in "Photographische Korrespondenz" 101 (1965) 37 – 42. The precipitation components, e.g. aqueous silver nitrate solution and halide solution, are added to the given emulsion by means of conventional feed pumps. One of the precipitation components is preferably added in a slight excess. The pAg in the emulsion vessel is constantly determined electrometrically and further addition of that precipitation component which is added in less than equivalent amount is regulated by the measured pAg so that a given pAg is maintained in the emulsion vessel with only slight fluctuations.

Conversion of the surface nuclei into the troglodyte nuclei according to the invention may also be carried out by means of Ostwald precipitation. In that case, the silver halide emulsion which has been chemically sensitized on the surface is mixed with a much finer grained emulsion of the same silver halide and kept at an elevated temperature for some time. The fine-grained emulsion dissolves in the mixture and is precipitated on the coarser grains. In the case of emulsions which still contain sufficient quantities of dissolved halides (e.g. emulsions which have not been treated with water) it is sufficient to add silver salt solutions alone, preferably a silver nitrate solution. Any freshly formed silver halide which is not directly precipitated on the chemically surface-sensitized silver halide emulsion but gives rise to new silver halide crystals due to the formation of new crystal nuclei can also be precipitated on the given surface-sensitized silver halide emulsion crystals by Ostwald ripening.

The first of the three methods mentioned above is preferred.

Conversion of the surface nuclei into the troglodyte nuclei according to the invention is preferably carried out before any spectral sensitization but may also be carried out afterwards.

According to another method of preparing the emulsions of the present invention, emulsions which contain silver halide grains with internal nuclei are used as starting materials. These silver halide grains are reduced in size by dissolving them so that the internal nuclei only just become accessible to nuclei surface developers.

The usual silver halide emulsions are suitable for this invention. The silver halides contained in them may be silver chloride, silver bromide or mixtures thereof, if desired with a small silver iodide content of up to 10 mols-%. Silver bromide, silver chlorobromide or silver iodobromide emulsions are preferred, especially those which contain at least 50 mols-% of silver bromide.

As already mentioned above, the emulsions may be chemically sensitized in the usual manner, e.g., by adding sulfur compounds at the stage of chemical ripening, for example allyl isothiocyanate, allyl thiourea, sodium thiosulfate and the like. Reducing agents may also be used as chemical sensitizers, e.g. the tin compounds described in Belgian Patent Specification Nos. 493,464 and 568,687 or polyamines such as diethylene triamine or aminomethyl sulfinic acid derivatives, e.g. according to Belgian Patent Specification No. 547,323.

Noble metals such as gold, platinum, palladium, iridium, ruthenium or rhodium or compounds of these metals are also suitable chemical sensitizers. This method of chemical sensitization has been described in the article by R. KOSLOWSKY, Z.Wiss.Phot. 46 (1951), 65 – 72.

The emulsions may also be sensitized with polyalkylene oxide derivatives, e.g. with polyethylene oxide having a molecular weight between 1000 and 20.000, or with condensation products of alkylene oxides and aliphatic alcohols, glycols, cyclic dehydration products of hexitols, alkyl-substituted phenols, aliphatic carboxyclic acids, aliphatic amines, aliphatic diamines and amides. The condensation products have a molecular weight of at least 700, preferably more than 1000. Combinations of these sensitizers may, of course, also be used in order to achieve special effects, as described in Belgian Patent Specification No. 537,278 and in British Patent Specification No. 727,982.

Quite general all methods are useful which are suitable for producing nuclei on the surface of the silver halide grain and which nuclei promote the production of photolytic silver.

The binder used for the photographic layers is preferably gelatin although this may be partly or completely replaced by other natural or synthetic binders. Suitable natural binders are e.g. alginic acid and its derivatives such as salts, esters or amides, cellulose derivatives such as carboxymethyl cellulose, alkyl cellulose such as hydroxyethyl cellulose, starch or its derivatives such as ethers or esters or carageenates. Polyvinyl alcohol, partly safonified polyvinyl acetate, polyvinyl pyrrolidone and the like are suitable synthetic binders.

The emulsions may also be optically sensitized, e.g. with the usual polymethine dyes such as neutrocyanines, basic or acid carbocyanines, rhodacyanines, hemicyanines, styryl dyes, oxanoles and the like. Sensitizers of this kind have been described in the work by F. M. HAMER "The Cyanine Dyes and Related Compounds" (1964), Interscience Publishers a division of John Wiley & Sons, New York.

In the emulsions according to the invention which contain troglodyte nuclei, the sensitizing dyes can be used without loss of sensitivity in concentrations which would cause desensitization in emulsions which contain surface nuclei. That highly advantageous effect is demonstrated in the diagram of the attached figure, wherein the minus blue sensitivity (obtained by spectral sensitization) as axis of ordinates is plotted against the ratio of the quantities of the spectral sensitizer and the silver halide in m/mol sensitizer/mol silver halide as axis of abscissas. Solid curve A shows the behaviour of a conventional silver halide emulsion being chemically sensitized according to common practice only at the surface as opposed to dashed curves B, C and D representing silver halide emulsions of the present invention containing troglodyte nuclei. The emulsions of the invention are prepared by continued precipitation of silver halide after chemical sensitization of the conventional comparison emulsion. Depending on the kind of the starting emulsion from which the emulsion according to the invention is prepared, the emulsion of the present invention shows a different behaviour upon addition of increasing amounts of sensitizing dye. Thus, the maximum of sensitivity can be reached with lower quantities (curve B), higher quantities (curve C) or about the same quantities of sensitizing dye (curve D) as compared with the maximum sensitivity of the conventional comparison emulsion (curve A). If the comparison emulsion is a silver halide emulsion with a relatively poor quantum yield, the maximum of the minus blue sensitivity of the corresponding emulsion of the present invention (prepared from the comparison emulsion) is reached with about the same amount or only a little higher amount (curve D) of the sensitizing dye as compared with the minus blue sensitivity of the comparison emulsion (curve A).

The silver halide emulsion of the present invention containing the so-called troglodyte nuclei are characterized by the following fact:

With unusual high amounts of sensitizing dye *a* sensitivity can be reached which is about the same (sensitivities *b*, *c*, *d*) as the maximum sensitivity of the comparison emulsion (obtained with much lower amounts of sensitizing dye) while with these high concentrations of sensitizing dye the sensitivity of the conventional silver halide emulsion (curve A) is already strongly reduced.

The optimum amount of the sensitizing dye added to the emulsions of the present invention which contain troglodyte nuclei depends on the effect desired and on the behaviour of the starting emulsion. The optimum amount can be determined by a few tests customary in the art of emulsion making. It is possible, for example, to add a relatively low amount of the sensitizing dye in the order of magnitude customarily added to conventional silver halide emulsions whereby, however, a much higher sensitivity is obtained. On the other hand, it is possible to add an unusual high amount of sensitizing dye, whereby about the same sensitivity is reached as the maximum sensitivity of the comparison emulsions with the advantageous effect, however, that the sensitizing dye now present at much higher concentrations act as screening dye so that a highly improved sharpness as compared with the conventional emulsion is obtained. Furthermore, it is of course possible to adjust the added amount of the sensitizing dye to reach improved sharpness as well as considerably increased sensitivity. The effects described above are readily apparent from the FIGURE attached hereto.

The emulsions may contain stabilizers, e.g. homopolar or salt-type compounds of mercury which contain aromatic or heterocyclic rings such as mercaptotriazoles, simple mercury salts, sulfonium mercury double salts and other mercury compounds. Azaindenes are also suitable stabilizers, especially tetra- or pentaazaindenes and particularly those which are substituted with hydroxyl or amino groups. Compounds of this kind have been described in the article by BIRR, Z. Wiss. Phot., 47 (1952), 2 – 58. Other suitable stabilizers include heterocyclic mercapto compounds, e.g. phenylmercaptotetrazole, quaternary benzothiazole derivatives, benzotriazole and the like. The emulsions may also contain compounds to stabilize the latent image, e.g. pyrocatechol.

The emulsions may be hardened in the usual manner with one ore more of the known hardeners, e.g. aldehydes, dialdehydes, dialdehyde starch, isonitriles in combination with aldehydes, di-isocyanates and derivatives thereof, carbonic acid derivatives, ketones, carbodiimides, carbamoyl pyridinium salts, bisepoxides, isoxazolium salts, bisacryloyl or polyacryloyl compounds, for example 1,3,5-tris-acryloylhexahydrotriazine, bis- or polyvinyl sulfonyl compounds, cyanuric chlorides (derivatives of mono-. di- and trichlorotriazine compounds) and mucochloric acid.

The support of the photographic recording material according to the invention may consist of any of the usual materials, for example cellulose esters such as cellulose acetate or acetobutyrate, polystyrene, polyesters, in particular polyethylene terephthalate, polycarbonates, glass, paper, aluminium and the like.

The photographic recording materials may contain developing agents such as aminophenols, ascorbic acid, pyrocatechols, hydroquinones, phenylene diamines or 3-pyrazolidones in the emulsion layer or some other layer.

The photographic materials according to the invention may be used for various purposes. They are suitable both for producing black and white photographic images and for producing color images. The photographic materials may be used e.g. for producing X-ray pictures and with suitable gradation they may also be used for reprographic purposes and for recording and copying purposes. They may contain the usual color couplers or they can be processed to colored photographic images by the developing-in process. They are also suitable for diffusion processes both for producing black and white images and for various color diffusion processes.

The silver halide emulsions according to the invention which contain troglodyte nuclei may be used in the individual emulsion layers of the photographic recording materials according to the invention either as individual emulsions or mixed with other conventional emulsions or emulsions according to the invention.

EXAMPLE 1

Preparation of the emulsion used as starting material: A homodisperse silver bromide emulsion was prepared by supplying 4.2 liters of 3-molar silver nitrate solution and at the same time the equimolar quantity of potassium bromide solution by the known double jet method to a solution of 90 g of gelatin in 800 ml of water at pH 5.0 and 55°C in the course of 7.5 hours while maintaining a pAg of 7.8 and adding 15 g of gelatin which had been allowed to swell in 15 ml of water to the reaction mixture every 15 minutes. The emulsion was left to solidify, shredded and washed. An emulsion with cubic silver bromide crystals with an edge length of 0.7$\mu$m was obtained.

This emulsion was melted at 43°C, adjusted to pAg 9.0 with 1-molar potassium bromide solution and then chemically ripened at 43°C and pH 6.6 for 30 minutes after the addition of 0.01 molar trisodium dithiosulfate aurate (I) solution (8 ml per kg of emulsion). When the emulsion had solidified and been shredded, it was extracted with 2 % potassium bromide solution for 1 hour and then washed in the usual manner. The emulsion then had a silver content in the form of silver halide of 10.2 % by weight. It was divided into two portions which were processed as follows:

Emulsion A (comparison emulsion)

The sample ws melted at 43°C, adjusted to pH 5.0 with 1-molar sulfuric acid and to pAg 7.8 with 1-molar silver nitrate solution, kept at 43°C for 22 minutes, adjusted to pAg 9.0 with 1-molar potassium bromide solution and then again solidified.

Emulsion 1 B (emulsion according to the invention)

This sample was also melted at 43°C and adjusted to pH 5.0 and pAg 7.8. Silver bromide was then precipitated on the silver bromide grains of this portion of emulsion by the double jet process, 18 O ml of 3-molar $AgNO_3$-solution and the equimolar quantity of KBr-solution being added per kg of emulsion in the course of 22 minutes. The pAg during this process was kept at 7.8. The emulsion was then adjusted to pAg 9.0 with 1-molar potassium bromide solution and again solidified. The quantity of silver bromide precipitated on the silver bromide cubes approximately corresponded to 18 lattice planes.

1 kg of 20 % gelatin solution and the quantities shown in Table I of the sensitizing dye of the following formula

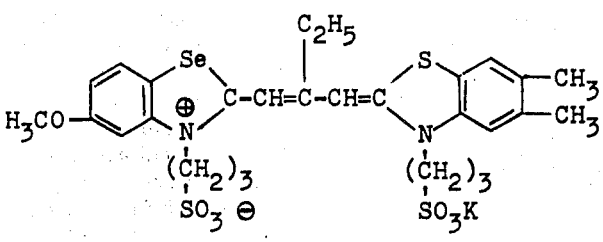

were added per mol of silver halide to various portions of the comparison emulsion (emulsion 1 A) and the emulsion according to the invention (emulsion 1 B) and the emulsions were then applied to a support of cellulose acetate at a concentration of 3.2 g of silver in the form of silver halide per $m^2$.

The photographic recording materials were exposed in a sensitometer and then developed to gamma 1.5 in a surface developer of the following composition:

| | |
|---|---|
| Water | 800 ml |
| p-methylaminophenol | 2.4 g |
| ascorbic acid | 10 g |
| sodium carbonate | 10 g |
| potassium bromide | 2.0 g |
| made up with water to | 1 liter |

The samples were fixed, washed and dried in the usual manner.

In addition, samples of recording materials which did not contain any sensitizing dye were exposed to their maximum black density and completely developed in the surface developer. Equally exposed samples were developed in developers which had been prepared from the surface developers by the addition of varying quantities of potassium iodide. The maximum density obtained with the surface developer was at least 83 % of the maximum densities obtained with developers to which potassium iodide had been added. According to H. ARENS and C. SCHRÖTER in "Z. Wiss. Phot.", volume 63 (1969), pages 97 et seq., this means that most of the emulsion grains had surface sensitivity. According to the above publication it is known that by addition of sodium thiosulfate (e.g. 2 g/l developer) to surface developer developing compositions are obtained which are capable of developing surface as well as internal latent images. Sodium thiosulfate, however, is disadvantageous since the silver covering power is decresed. Furthermore, it is known that the same effect with respect to the capability of developing also internal nuclei can be achieved if potassium iodide is added to surface developer without, however, any concomitant deleterious effect on the silver covering power. The concentration of the potassium iodide has to be adjusted carefully (e.g. 5 — 500 mg/l developer) to reach the maximum density. The effect of the potassium iodide concentration is described herein before.

The other results of sensitometric determinations are summarized in Table I below:

Table I

| Emulsion | Quantity of sensitising dye*) (mMol/mol Ag) | Relative blue sensitivity | Relative minus blue sensitivity |
|---|---|---|---|
| Emulsion 1 A | 0 | 100 | — |
| (comparison | 0.03 | 83 | 51 |
| emulsion | 0.10 | 63 | 110 |
| containing 0.20 | 37 | 98 | |
| surface | 0.40 | 26 | 65 |
| nuclei) | 0.80 | 14 | 43 |
| | 1.13 | 12 | 36 |
| Emulsion 1 B | 0 | 220 | — |
| (emulsion | 0.03 | 210 | 115 |
| according to | 0.10 | 180 | 280 |
| the invention | 0.20 | 87 | 230 |
| containing | 0.40 | 74 | 230 |
| troglodyte | 0.80 | 66 | 220 |
| nuclei) | 1.13 | 56 | 170 |

*)Maximum sensitisation at 660 nm

In emulsion 1 B according to the invention, the blue sensitivity decreases with increasing dye concentration at only about half the rate as in the comparison emulsion 1 A. For a given quantity of sensitising dye, the blue sensitivity is invariably higher in emulsion 1 B according to the invention than in comparison emulsion 1 A. When the quantity of sensitising dye is increased from 0.10 mMol/mol $A_g$ to 0.80 $_m$Mol/mol Ag, the minus blue sensitivity falls to 78% in emulsion 1 B according to the invention but to 38% in comparison emulsion 1 A. The maximum minus blue sensitivity is 2.5 times as great in emulsion 1 B as in emulsion 1 A.

Emulsion 1 B according to the invention has practically the same grain size as comparison emulsion 1 A because the length of edge of emulsion grains has only increased by 2 % as a result of the additional precipitation of silver halide. The ratio of sensitivity to grain size is therefore substantially better in emulsion 1 B according to the invention than in comparison emulsion 1 A.

EXAMPLE 2

The same homodisperse, chemically surface-sensitized silver bromide emulsion was used in this example as in Example 1. The emulsion was again divided into two portions and these were treated as follows:

Emulsion 2 A (comparison emulsion)

The sample was melted at 43°C, adjusted to pH 5.0 with 1-molar sulfuric acid and to pAg 7.8 with 1-molar silver nitrate solution, kept at 43°C for 28 minutes, adjusted to pAg 9.0 with 1-molar potassium bromide solution and then again solidified.

Emulsion 2 B (emulsion according to the invention)

This sample was also melted at 43°C and adjusted to pH 5.0 and pAg 7.8. Silver bromide was then precipitated on the silver bromide grains of this portions of emulsion by the double jet method, 24.0 ml of 3-molar silver nitrate solution and the equimolar quantity of potassium bromide solution per kg of emulsion being added at pAg 7.8 in the course of 28 minutes. The emulsion was then adjusted to pAg 9.0 with 1-molar potassium bromide solution and again solidified. The quantity of silver bromide precipitated on the silver bromide cubes corresponded to approximately 24 lattice planes.

1 kg of 20% gelatine solution per mol of silver halide and the quantities indicated in Table II of the sensitising dye of the following formula

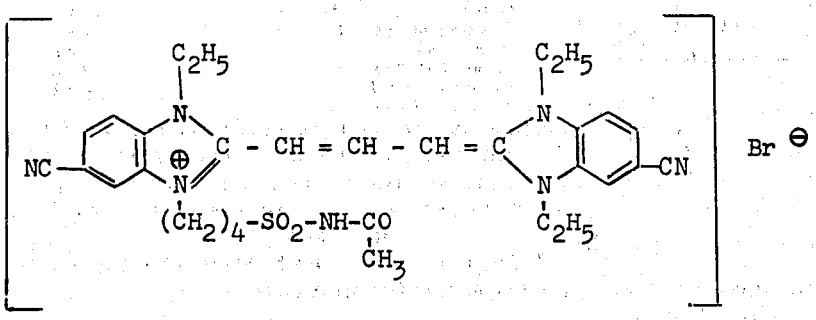

where added to various portions of comparison emulsion 2 A and emulsion 2 B according to the invention and the emulsions were then applied to a cellulose acetate film support at a concentration of 3.2 g of silver per m². Exposure and development of the photographic materials were carried out as described in Example 1. To the same extent as in Example 1, most of the emulsion grains had surface sensitivity. The other results of sensitometric determinations are summarised in Table II.

For a given quantity of sensitising dye, the blue sensitivity is invariably higher in emulsion 2 B according to the invention than in comparison emulsion 2 A. When the quantity of sensitising dye is increased from 0.10 mMol/mol Ag to 0.80 mMol/mol Ag, the minus blue sensitivity falls to 44% in emulsion 2 B according to the invention but to 26% in comparison emulsion 2 A. The maximum minus blue sensitivity is 2.5 times as great in emulsion 2 B according to the invention as in comparison emulsion 2 A. The ratio of sensitivity to grain size is better in emulsion 2 B according to the invention than in comparison emulsion 2 A.

Table II

| Emulsion | Quantity of sensitising dye*) (mMol/mol Ag) | Relative blue sensitivity | Relative minus blue sensitivity |
|---|---|---|---|
| Emulsion 2 A (comparison emulsion | 0 | 100 | — |
| | 0.10 | 81 | 80 |
| | 0.20 | 77 | 87 |

Table II-continued

| Emulsion | Quantity of sensitising dye*) (mMol/mol Ag) | Relative blue sensitivity | Relative minus blue sensitivity |
|---|---|---|---|
| containing surface nuclei) | 0.40 | 60 | 62 |
| | 0.80 | 22 | 21 |
| Emulsion 2 B (emulsion according to the invention containing troglodyte nuclei) | 0 | 200 | — |
| | 0.10 | 180 | 220 |
| | 0.20 | 170 | 170 |
| | 0.40 | 160 | 170 |
| | 0.80 | 98 | 98 |

*)Maximum sensitisation at 583 nm

EXAMPLE 3

A heterodisperse silver iodobromide emulsion containing 5.5 mols-% of iodide is prepared by adding a solution of 90 g of silver nitrate in 720 ml of water to a solution of 24 g of gelatine, 70 g of potassium bromide and 5.7 g of potassium iodide in 1200 ml of water at 60°C in the course of 7 minutes. After the addition of 160 g of gelatine, the mixture was stirred at 60°C for 20 minutes and then solidified and washed. After the addition of 1.5 mMol of potassium thiocyanate and 0.03 mMol of chloroauric acid, the washed emulsion was chemically ripened for 3 hours at 50°C, pH 6.5 and pAg 8.7. The resulting emulsion, which had a silver content of 2.6% by weight in the form of silver halide, was divided into two portions and treated as described below.

Emulsion 3 A (comparison emulsion)

The sample was melted at 35°C, adjusted to pH 5.0 with 1-molar sulfuric acid and to pAg 8.5 with 1-molar silver nitrate solution, kept at 35°C for 10 minutes, adjusted to pAg 9.8 with 1-molar potassium bromide solution, again kept at 35°C for 10 minutes and then solidified.

Emulsion 3 B (emulsion according to the invention)

This sample was also melted at 35°C and adjusted to pH 5.0 and pAg 8.5. Silver bromide was then precipitated on the silver iodobromide grains of this portion of emulsion by the double jet method, 1.75 ml of 3-molar silver nitrate solution per kg of emulsion and the equimolar quantity of potassium bromide solution being added at pAg 8.5 in the course of 10 minutes. The emulsion was then adjusted to pAg 9.8 with 1-molar potassium bromide solution and silver bromide was again precipitated by the method described above, 1.75 ml of 3-molar silver nitrate solution per kg of emulsion and the equimolar quantity of potassium bromide solution being added at pAg 9.8 in the course of 10 minutes. The emulsion was then solidified.

The sensitising dye mentioned in Example 1 was added in the quantities per mol of silver halide shown in Table III to various samples of comparison emulsion 3 A and of emulsion 3 B according to the invention and the emulsions were then applied to the support of cellulose acetate at a concentration of 3.2 g of silver in the form of silver halide per $m^2$. The photographic recording materials were exposed in a sensitometer and then developed to gamma 0.7 in the nuclear surface developer indicated in Example 1. The samples were fixed, washed and dried in the usual manner. The results of sensitometric determinations are summarised in Table III.

Table III

| Emulsion | Quantity of sensitising dye*) (mMol/mol Ag) | Relative blue sensitivity | Relative minus blue sensitivity |
|---|---|---|---|
| Emulsion 3 A | 0 | 100 | — |
| (comparison | 0.10 | 80 | 23 |
| emulsion | 0.20 | 80 | 37 |
| containing | 0.40 | 72 | 32 |
| surface | 0.80 | 55 | 31 |
| nuclei) | 1.60 | 32 | 24 |
| Emulsion 3 B | 0 | 112 | — |
| (emulsion | 0.10 | 100 | 26 |
| according to | 0.20 | 91 | 41 |
| the invention | 0.40 | 72 | 56 |
| containing | 0.80 | 63 | 62 |
| troglodyte | 1.60 | 51 | 45 |
| nuclei) | | | |

*)Maximum sensitisation at 660 nm

In addition, samples which had been exposed to maximum density as in Example 1 were completely developed, same in the surface developer and others in developers to which potassium iodide had been added. The maximum density obtained with the surface developer was at least 95% of the maximum densities obtained with the developers which contained iodide. Most of the emulsion grains therefore had suface sensitivity.

Although the blue sensitivity of emulsion 3 B according to the invention is only slightly higher than that of comparison emulsion 3 A, the maximum minus blue sensitivity of emulsion 3 B according to the invention is 1.6 times that of comparison emulsion 3 A. At the concentration of sensitiser at which emulsion 3 B according to the invention reaches its maximum minus blue sensitivity (0.80 mMol/mol Ag), comparison emulsion 3 A has only half the minus blue sensitivity.

I claim:

1. A photographic material containing at least one light-sensitive spectrally sensitized silver halide emulsion layer, wherein the emulsion contains silver halide grains with ripening nuclei capable of forming developable latent image nuclei upon exposure and being developable after exposure in the surface developer of the following composition:

| | |
|---|---|
| Water | 800 ml |
| p-methylaminophenol | 2.4 g |
| ascorbic acid | 10.0 g |
| sodium carbonate | 10.0 g |
| potassium bromide | 2.0 g |
| made up with water to | 1 liter |

wherein the improvement comprises more than 50% of the grains in the emulsion contain ripening nuclei which are in cavities within the silver halide grains which cavities are open to the outside of the surface of the grains.

2. The material of claim 1, wherein the depth of the cavities is 5 to 50 lattice planes.

* * * * *